US008341987B2

(12) United States Patent
Nagelski

(10) Patent No.: US 8,341,987 B2
(45) **Date of Patent: *Jan. 1, 2013**

(54) SECURITY DEVICE FOR ATTACHING A PEG HOOK TO A PEG SUPPORT

(75) Inventor: Keith C. Nagelski, Huntersville, NC (US)

(73) Assignee: InVue Security Products Inc., Charlotte, NC (US)

( * ) Notice: Subject to any disclaimer, the term of this patent is extended or adjusted under 35 U.S.C. 154(b) by 691 days.

This patent is subject to a terminal disclaimer.

(21) Appl. No.: 11/968,709

(22) Filed: Jan. 3, 2008

(65) Prior Publication Data

US 2008/0169250 A1 Jul. 17, 2008

Related U.S. Application Data

(60) Provisional application No. 60/879,920, filed on Jan. 11, 2007.

(51) Int. Cl.
*E05B 47/00* (2006.01)
*E05B 73/00* (2006.01)

(52) U.S. Cl. ..... 70/276; 70/57.1; 70/62; 70/413; 211/7; 211/54.1; 211/57.1; 211/59.1

(58) Field of Classification Search ..... 211/4, 7, 211/54.1, 57.1, 59.1; 70/14, 32–34, 57.1, 70/59–63, 57, 276, 413; 411/535, 536; 248/551; 292/251.5

See application file for complete search history.

(56) References Cited

U.S. PATENT DOCUMENTS 1,435,433 A * 11/1922 Triggs ..... 411/532
2,932,538 A * 4/1960 Holmes ..... 294/65.5
3,060,785 A 10/1962 Corlett et al.
3,078,704 A * 2/1963 Rifkin ..... 70/90
3,263,727 A * 8/1966 Herpolsheimer ..... 411/136
3,566,636 A 3/1971 Rudolf et al.
3,656,328 A * 4/1972 Hughes ..... 70/276
3,837,195 A 9/1974 Pelto
4,022,038 A 5/1977 Miller
4,127,996 A * 12/1978 Malminen et al. ..... 70/365
4,425,771 A * 1/1984 Beach et al. ..... 70/276
4,433,879 A * 2/1984 Morris ..... 384/626
4,452,497 A 6/1984 Zillhardt
4,462,497 A 7/1984 Maule
4,682,906 A * 7/1987 Ruckert et al. ..... 384/626
5,288,191 A * 2/1994 Ruckert et al. ..... 411/432

(Continued)

FOREIGN PATENT DOCUMENTS

DE 19843036 A1 3/2000

(Continued)

*Primary Examiner* — Carlos Lugo
*Assistant Examiner* — Alyson M Merlino
(74) *Attorney, Agent, or Firm* — Christopher C. Dremann, P.C.

(57) ABSTRACT

A security device for locking a merchandise display rod to a support structure. The device includes a housing slidably received on the display rod and including a locking mechanism movable between a locked and an unlocked position. The housing defines a recess extending inwardly from an exterior surface thereof and perpendicularly to the linear motion of a locking member in the locking mechanism. A complementary shaped dipole magnet of a magnetic key is inserted into the recess to move the locking mechanism to the unlocked position. The security device further includes an adjustment member on a rear surface thereof. The adjustment member is engaged to compensate for different thicknesses of the support structure to which the security device is to be attached.

13 Claims, 8 Drawing Sheets

U.S. PATENT DOCUMENTS

| | | | | |
|---|---|---|---|---|
| 5,600,977 | A * | 2/1997 | Piron | 70/57.1 |
| 5,676,258 | A | 10/1997 | Leyden et al. | |
| 5,895,189 | A * | 4/1999 | Ruckert | 411/535 |
| 6,003,685 | A | 12/1999 | Malin | |
| 6,474,478 | B1 | 11/2002 | Huehner et al. | |
| 7,007,810 | B2 * | 3/2006 | Huehner et al. | 211/57.1 |
| 7,178,678 | B2 | 2/2007 | Mansfield et al. | |
| 7,392,673 | B2 * | 7/2008 | Fawcett et al. | 211/7 |
| 7,703,308 | B2 * | 4/2010 | Nagelski | 70/57.1 |
| 7,708,153 | B2 * | 5/2010 | Mansfield et al. | 211/7 |
| 2004/0026344 | A1 | 2/2004 | Sedon et al. | |
| 2006/0157431 | A1 * | 7/2006 | Nagelski et al. | 211/54.1 |
| 2009/0057244 | A1 * | 3/2009 | Conti et al. | 211/7 |

FOREIGN PATENT DOCUMENTS

| | | | |
|---|---|---|---|
| FR | 2690421 | A3 | 10/1993 |
| GB | 2305212 | A | 4/1997 |

* cited by examiner

SECURITY DEVICE FOR ATTACHING A PEG HOOK TO A PEG SUPPORT

CROSS-REFERENCE TO RELATED CASES

This is a standard utility application claiming priority from U.S. Provisional Application Ser. No. 60/879,920, filed Jan. 11, 2007, the entire disclosure of which is incorporated herein by reference.

BACKGROUND OF THE INVENTION

1. Technical Field

This invention generally relates to merchandise display systems that are attached to a display board or a wire display rack. More particularly, the present invention relates to display systems that either prevent the rapid removal of items of merchandise from the display system or prevent removal of items of merchandise when the display system is locked. Specifically, the invention relates to display systems that can be locked to a display board to prevent the removal of the entire display system and attached merchandise from the display rack and that can only be unlocked using a specially configured magnetic key.

2. Background Information

Items of merchandise are commonly displayed for sale on long protruding rods supported from peg board or slat board. These protruding rods are commonly referred to in the art as peg board hooks or slat board hooks. Similar rods may also protrude from a wire display rack for the same purpose. Usually, the items of merchandise are of a smaller range, such as batteries or small tools or other components. Such merchandise is an easy target for shoplifters because they can rapidly remove all of the items from a display system and remove the merchandise from the store without being detected. Alternately, the entire display system with all the merchandise thereon can be removed from peg boards and the like if they are not locked thereon.

The prior art discloses various devices and mechanisms for securing the end of a display rod to a display board. For example, U.S. Pat. No. 5,676,258 to Leyden includes a Z-shaped plate which has two legs that clamp a section of a display wall or display board therebetween. A pair of screws extend between the two legs. Consequently, the only way to detach that end of the display rod is to use a screwdriver to release the screws.

U.S. Pat. No. 4,452,497 to Maule has an upright support that connects the first ends of two spaced apart rods together. The rods are fixed to the upright support and the upright support, in turn, is fixed to a supporting wall, or display board, by fasteners. A thief would have to detach the entire upright support from the wall and even then, the first ends of the rods are fixed into the support so the merchandise would not be releasable from the display system.

U.S. Pat. No. 6,474,478 to Huehner et al, assigned to the present assignee, discloses a security device that is used to lock a peg hook to a pegboard support and thereby prevent unauthorized removal of the peg hook together with the products displayed thereon. The security device includes a locking base assembly that prevents the removal of the device without the use of a specially designed key. The locking base assembly includes an inner base and an outer base. The outer base slidingly engages the inner base. A flange protrudes outwardly from either side of inner base and these flanges are received in slots in the outer base as the inner and outer bases are engaged. At least one of the flanges includes a protruding lock member that catches and locks against a ledge in the outer base. A set of key holes is provided in the outer base. The base assembly can only be unlocked when pins from a specially designed key are inserted through the key holes to depress the lock member and thereby disengage the same from the ledge.

U.S. Pat. No. 7,178,678, issued to Mansfield et al, and assigned to the present assignee, discloses a merchandise display hook used to display items of merchandise from a support structure. A base assembly slidably engages a rod on the display hook. The base assembly includes a magnetically-actuatable lock that engages a portion of the rod. When the lock is in an unlocked position, the base assembly can slidingly move along the rod and the display hook can be removed from the support. When the lock is in a locked condition, the base assembly cannot slidingly move along the rod and the display hook is therefore locked onto the support. The lock is moved from the locked position to the unlocked position by way of a key that includes a magnet. The key is placed on the exterior surface of the base assembly in the proximity of the lock. The magnet in the key magnetically attracts the lock toward the exterior surface of the base assembly, and thereby disengages the lock from the rod.

U.S. Publication No. 2006/0157431, to Nagelski et al, and assigned to the present assignee, discloses a lock mechanism for a display rod that secures merchandise thereon and a special magnetic key for unlocking the same. The security device includes a lock with a magnetically attractable plunger housed in a chamber therein. The plunger moves linearly within the chamber between a locked position and an unlocked position. When the plunger is in the locked position it engages the display rod and prevents merchandise from being removed therefrom. When the plunger is in the unlocked position it does not engage the display rod and merchandise may therefore be removed from the rod. While the chamber is proximate the exterior surface of the device, it's existence and position would not be evident from a simple external examination of the device. Similarly, because of the key comprises a magnet that is completely surrounded by a housing, a simple external examination of the key would not reveal that there is a magnet in its interior. Even if it was determined that a magnet was needed to unlock the device, the location of the locking mechanism would be difficult to determine without spending a considerable amount of time manipulating the device and a bar magnet. This time spent would make it more likely that the thief will be caught in the act. The specially designed magnetic key for use by authorized personnel is disclosed in the publication as having a locating tab that must be engaged in a positioning groove in the exterior surface of the security device. This correctly positions the magnet on the exterior surface of the device and adjacent the locking mechanism. If the locating tab is not engaged in the positioning groove, then the magnet will not be correctly positioned on the security device's exterior surface, the plunger will not move and the device will remain locked.

In the above two merchandise display systems, a considerable amount of effort has to be applied by a thief to remove the display system from a display board. This makes it difficult to steal the items of merchandise thereon. However, it also makes it difficult for the retailer to reposition the display system on a display board.

There is therefore a need in the art to provide a merchandise display system that prevents the removal of the display system from a peg board, but is at the same time both easily and quickly released for repositioning on the peg board.

SUMMARY OF THE INVENTION

The device of the present invention comprises a security device for locking a merchandise display rod to a support structure. The device includes a housing slidably received on the display rod and including a locking mechanism movable between a locked and an unlocked position. The housing defines a recess extending inwardly from an exterior surface thereof and perpendicularly to the linear motion of a locking member in the locking mechanism. A complementary shaped dipole magnet of a magnetic key is inserted into the recess to move the locking mechanism to the unlocked position. Preferably the dipole magnet is a sintered neodymium, iron, boron (NdFeB) magnet that has a D-shaped cross-section. The security device further includes an adjustment member on a rear surface thereof. The adjustment member is engaged to compensate for different thicknesses of the support structure to which the security device is to be attached. Preferably, the adjustment member comprises a pin having a shaft that is rotatably received in an aperture in a receptor on the rear surface of the housing. The pin has a head with an outer surface that only abuts the support structure when the pin is rotated to extend the head outwardly beyond the plane of the rear surface of the security device.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
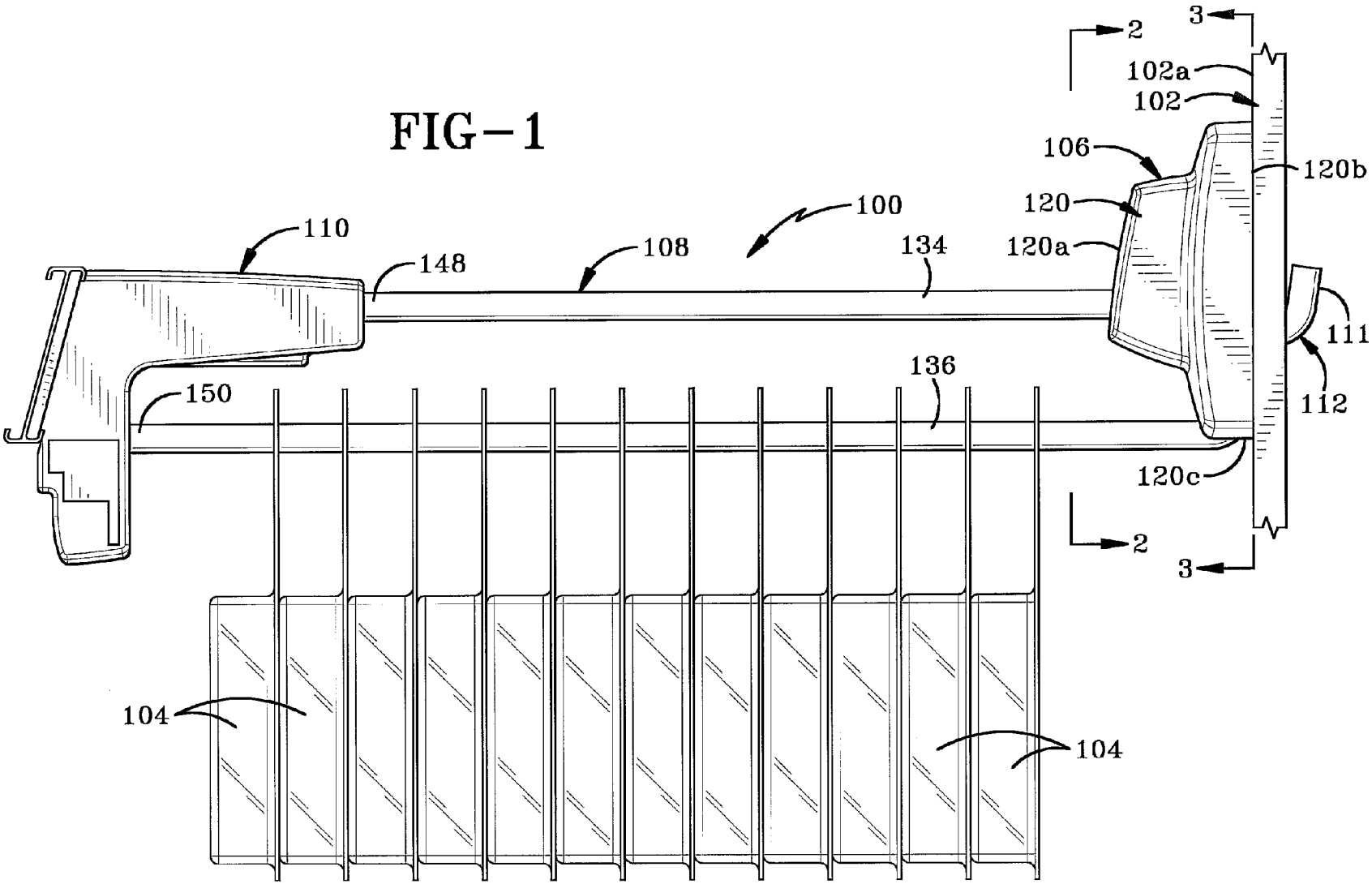
FIG. 1 is a side elevational view of a merchandise display system of the present invention connected to a display board and having a plurality of items of merchandise hanging therefrom.
Figure 2:
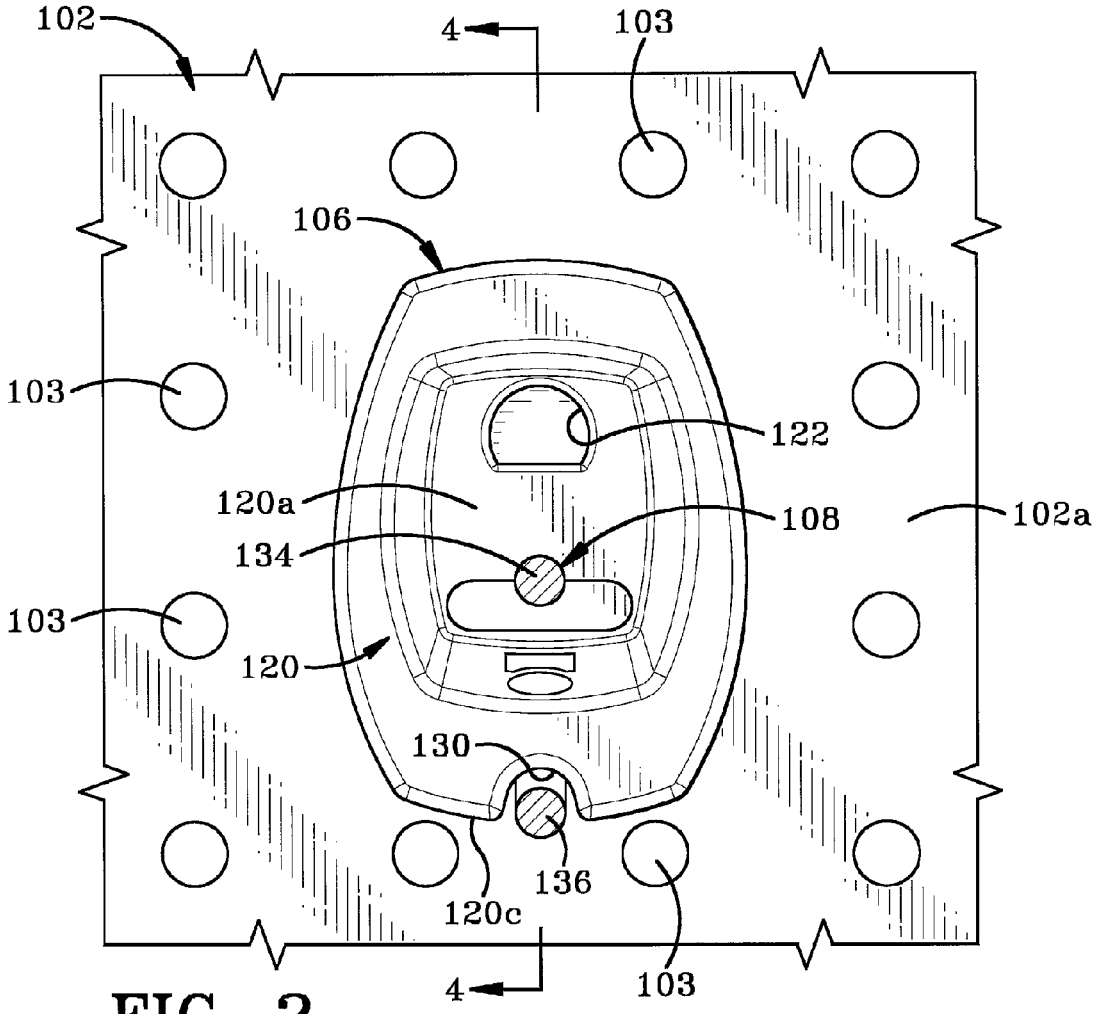
FIG. 2 is a front elevational sectional view of the display system through line 2-2 of FIG. 1.
Figure 3:
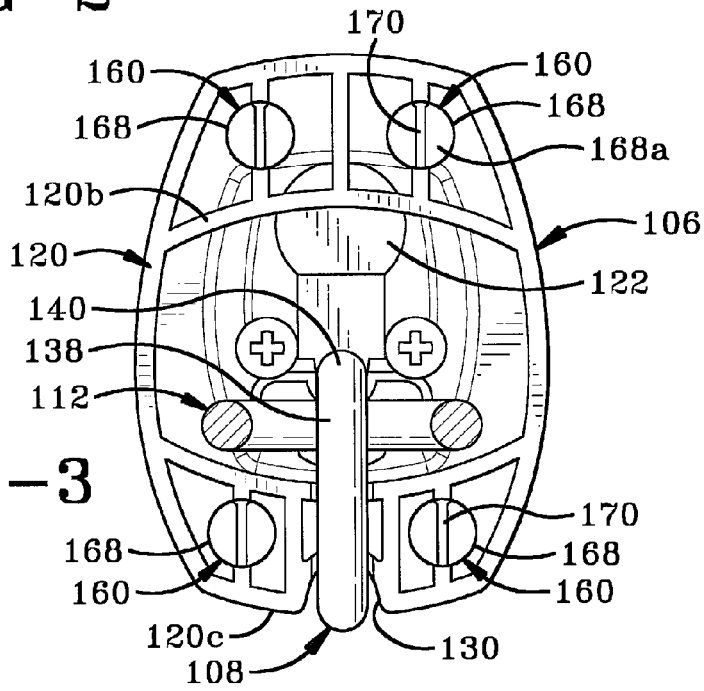
FIG. 3 is a rear elevational sectional view of the display system through line 3-3 of FIG. 1.
Figure 4:
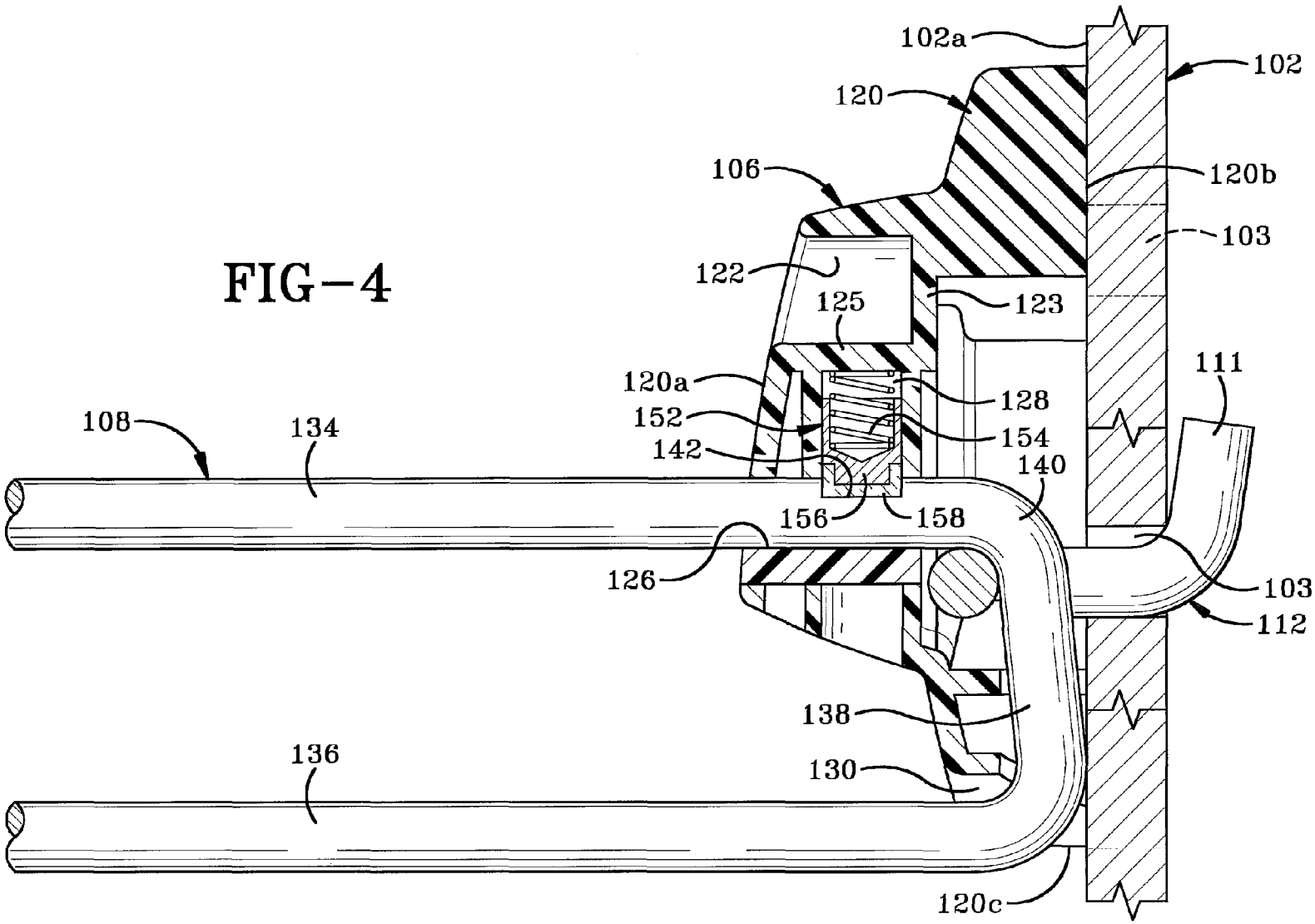
FIG. 4 is a fragmentary sectional side view through line 4-4—of FIG. 2 and showing the rod assembly and the base assembly in a locked position.

The merchandise display system of the present invention is indicated generally by the numeral 100, and is shown in FIGS. 1-15. Display system 100 is used with a display board 102 (peg board or slat board) to support items 104 of merchandise for display in a retail environment. Display system 100 comprises a rod assembly 108, a base assembly 106 and an end assembly 110. Rod assembly 108 has a board-engaging end 112 comprising a pair of upwardly extending members 111 that are receivable through holes 103 in display board 102 to removably mount rod assembly 108 thereto in a cantilevered manner. End assembly 110 is provided to lockably secure merchandise on rod assembly.

End assembly 110 is the subject of a concurrently filed U.S. patent application by the present inventor entitled DISPLAY HOOK ASSEMBLY HAVING A SECURE FREE END". A second concurrently filed application by the present inventor is directed to a key for unlocking both end assembly 110 and base assembly 106. This second application is entitled MAGNETIC KEY FOR USE WITH A SECURITY DEVICE. The entire disclosures of these two related applications are incorporated herein by reference.

Figure 5:
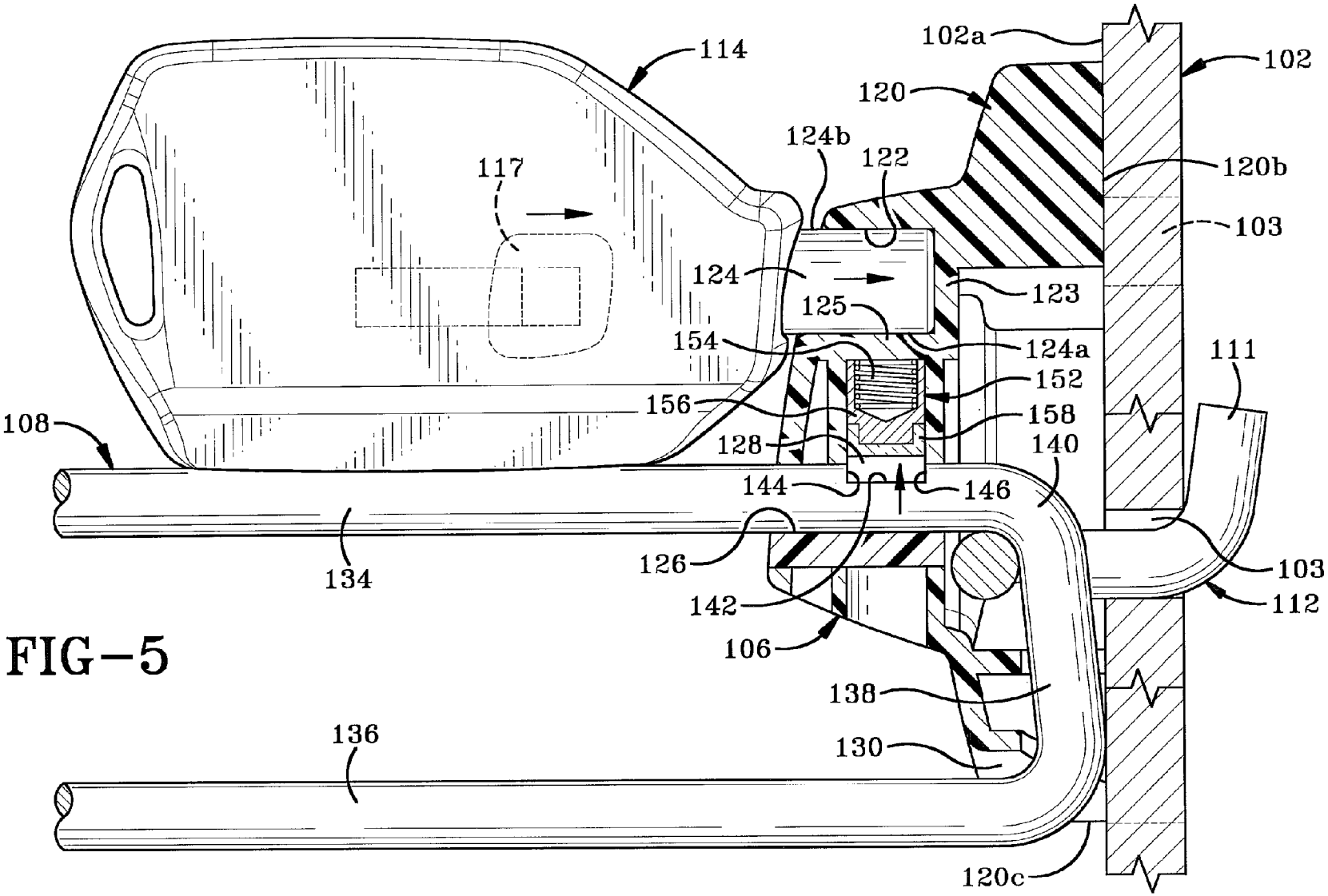
FIG. 5 is a sectional view similar to FIG. 4, showing an unlocked position with a key having unlocked the based assembly from the rod assembly.

The present invention is directed specifically toward the lockable base assembly 106 of display system 100. Base assembly 106 is engageable with rod assembly 108 and includes a locking mechanism, as will be disclosed hereinafter, to lockably secure rod assembly 108 to display board 102. When in a locked position, base assembly 106 secures rod assembly 108 to display board 102 in a manner that prevents rod assembly 108 from being removed from holes 103 on display board 102 without the use of a specific key 114 (FIG. 5). As used in this application, the term "locking" is different from a simple "latched" connection. A "latched" connection may be unlatched without the use of a special key, while a "locked" connection requires a special key. Key 114 is designed to be usable with both the base assembly 106 and end assembly 110 of display system 100 to unlock the same.

Base assembly 106 comprises a housing 120 having a front **120*a* and a back 120*b*. Back 120*b* is substantially planar and is adapted to be disposed proximate an outer surface 102*a* of display board 102. Front 120*a* of housing projects outwardly away from the back 120*b* thereof, preferably forming two stepped regions that have different dimensions (FIG. 1). Front 120*a* defines a specifically shaped recess 122 therein that is complementary sized and shaped to accept a protuberance 124 of key 114 therein as will be hereinafter described. Recess 122 terminates in a wall 123 that is spaced a distance forwardly away from back 120*b* of housing 120**.

It is contemplated that base assembly 106, end assembly 110 and key 114 will be designed for industry or store-specific use. As such, each industry or store will have a security system that includes a specifically shaped recess 122 in both the base and end assemblies 106, 110. These base and end assemblies 106, 110 will only be able to be unlocked with a customized key 114 having a complementary shaped cross-sectional profile that allows the key to be inserted into the specifically shaped recess 122. In the preferred embodiment of the invention, recess 122 is substantially D-shaped and can only be accessed by a complementary sized D-shaped key 114. Recess 122 could be otherwise shaped, such as trapezoidal and then the key 114 would have a complementary trapezoidal cross-section. This arrangement substantially reduces the possibility of a would-be thief unlocking the base assembly 106 with a commonly available magnet.

Housing 120 of base assembly 106 defines a hole 126 and passage 130 adjacent a lower end **120*c* of housing for engagement with rod assembly 108. Housing 120 further defines an interior chamber 128 which is disposed above and communicates with hole 126 and is separated from recess 122 by a second wall 125. The locking mechanism for base assembly 106 is retained within interior chamber 128** as will be hereinafter described.

Rod assembly 108 includes an upper rod 134 and a lower rod 136 joined by a connecting rod 138 adjacent an inner end 140 of rod assembly 108. Upper rod 134 defines an upwardly facing notch 142 (FIG. 6) adjacent inner end 140 of rod assembly 108. Notch 142 is bounded by side edges 144, 146. Both upper and lower rods 134, 136 are cylindrical in cross-section and have outer ends 148, 150 respectively that engage end assembly 110.

In accordance with a specific feature of the present invention, a locking mechanism 152 is disposed within chamber 128 of base assembly 106. Locking mechanism 152 locks base assembly 106 and rod assembly 108 together. Locking mechanism 152 includes a compression spring 154 seated in a shuttle assembly 156. Shuttle assembly 156 is complementary shaped and sized for reciprocal travel within interior chamber 128 of base assembly 106. A base portion 158 of shuttle assembly 156 is complementary shaped and sized to be received in a notch 142 in upper rod 134 of rod assembly 108. Base portion 158 is sized to be tightly retained between side edges 144, 146 of rod 134 which defines notch 142. When base portion 158 of locking mechanism 152 is so engaged, base assembly 106 cannot be slidably moved along rod 134.

In accordance with another specific feature of the present invention, shuttle assembly 156 may be made from a metal that is attracted to magnets or may itself be manufactured from a metal that has magnetic properties. Base portion 158, on the other hand, is manufactured from an insulating material that is not and cannot be magnetized. A suitable material for base portion 158 is plastic. The insulating base portion 158 substantially prevents the magnetic force field emanating from key 114 from attracting rod 134 toward it during unlocking of the base assembly 106.

Figure 6:
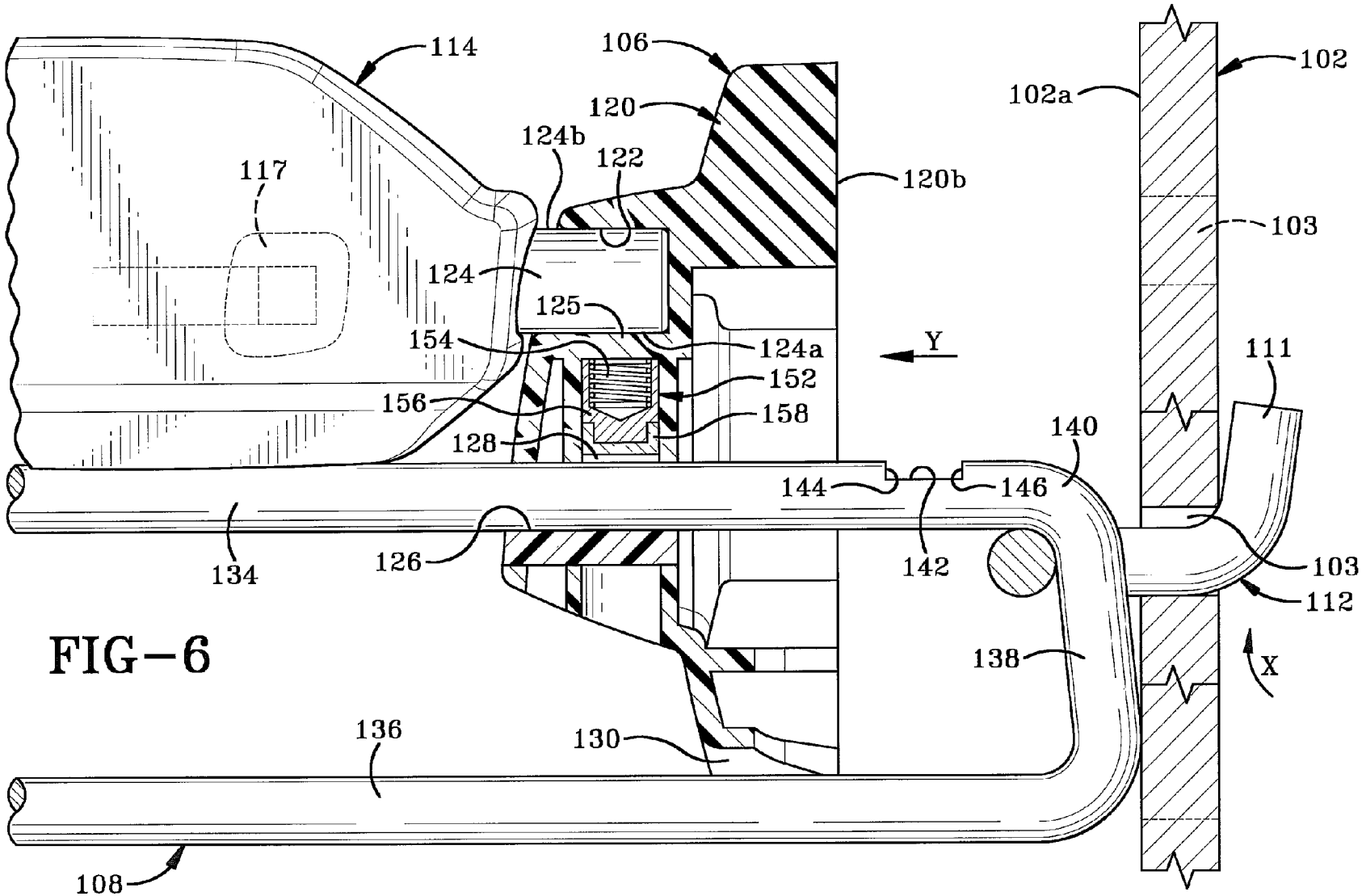
FIG. 6 is a fragmentary sectional view of the display system showing the rod assembly and the base assembly in an unlocked position with the base assembly slid outwardly along the rod assembly.
Figure 7:
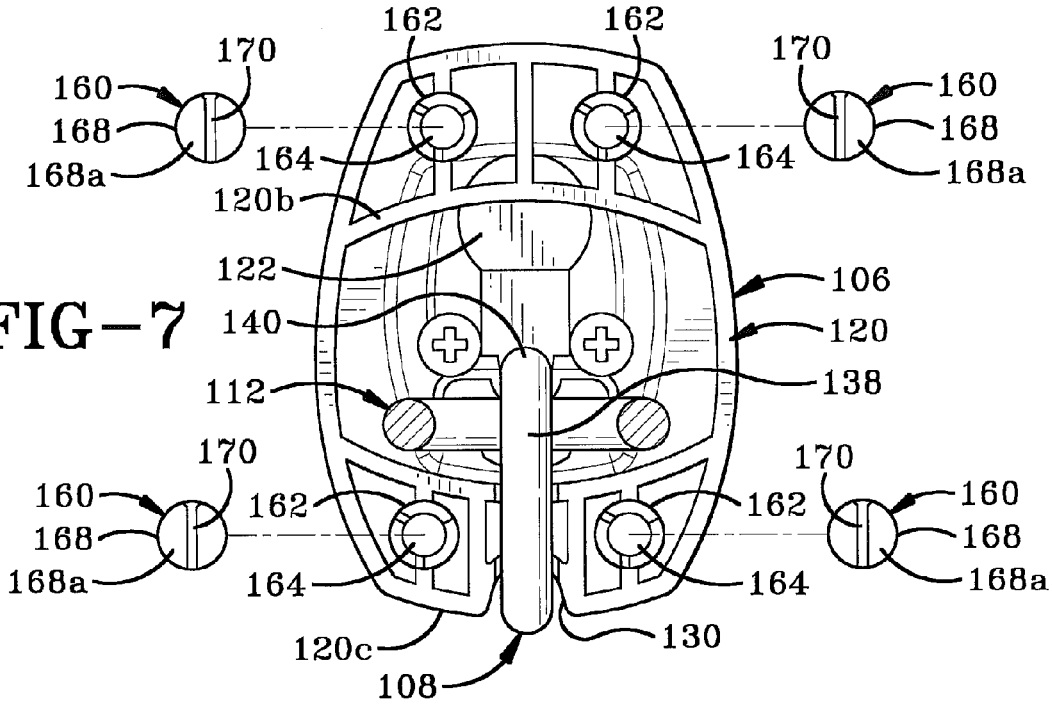
FIG. 7 is a partially exploded rear elevational view of the display system.
Figure 13:
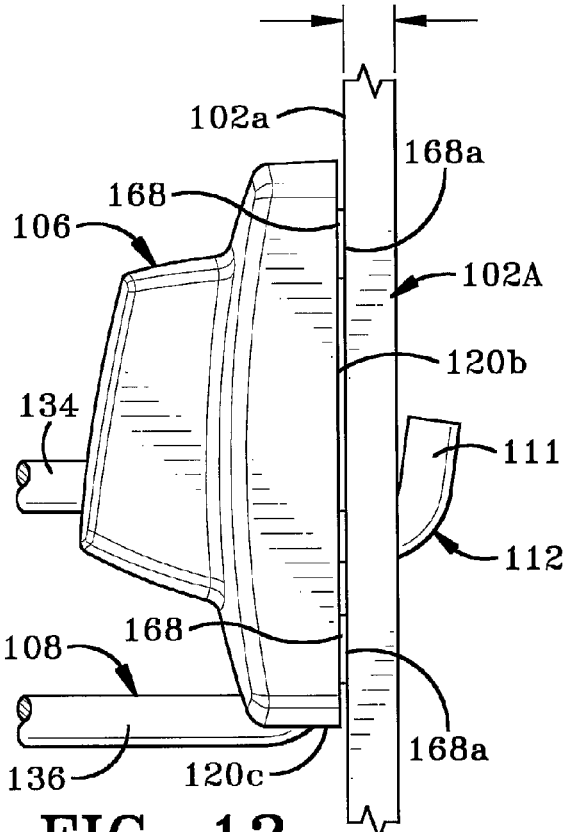
FIG. 13 is a side elevational view of the base assembly and rod assembly of FIG. 12 engaged with a thicker peg board.

Base assembly 106 is used in the following manner. Ends 148, 150 of rods 134, 136 are introduced through back 120*b* of housing 120 and into hole 126 and passageway 130 of base assembly 106. Base assembly 106 is slidingly moved along rod assembly 108 in a direction opposite to "Y" (FIG. 6). Upper rod 134 slidably and lockably extends through hole 126 of base assembly 106 and lower rod 136 likewise slidably passes through passage 130 of base assembly 106.

When rod assembly 108 is to be secured to display board 102, upturned members 111 are introduced through a pair of adjacent holes 103 in display board 102. Base assembly 106 is slidingly moved along rod assembly 108 in an opposite direction to "Y". When notch 142 of rod 134 is positioned adjacent locking mechanism 152, the spring-biased shuttle assembly 156 automatically moves downwardly within chamber 128. Base portion 158 enters notch 142 and engages side edges 144, 146 thereby substantially preventing base assembly 106 from being slidably moved in either direction relative to rod assembly 108. Thus, rod assembly 108 and base assembly 106 are secured together and they cannot be disengaged from each other without key 114.

Figure 9:
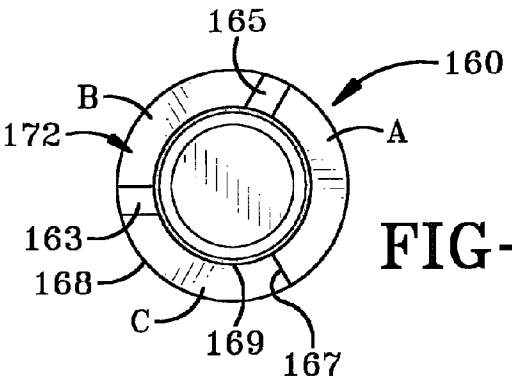
FIG. 9 is an end view of the adjustment screw of FIG. 8.
Figure 8:
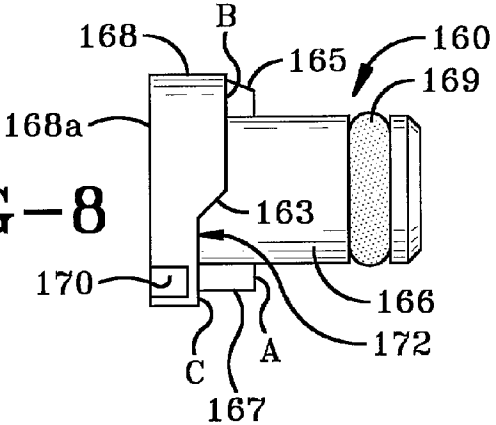
FIG. 8 is a side view of the one of the adjustment screws of FIG. 7.

Referring to FIGS. 7-15, and accordance with another specific feature of the present invention, base assembly 106 is provided with a plurality of adjustment pins 160 to allow base assembly 106 and rod assembly 108 to be locked onto different thicknesses of display board 102. Housing 120 is molded with a plurality of cylindrically elongated pin receptors 162. Preferably, housing 120 includes two receptors 162 positioned near both the top end and bottom end of housing 120. Receptors 162 define apertures 164 therein that open toward the back 120*b* of housing 120. As shown in FIGS. 8 and 9, adjustment pins 160 include a shaft 166 and a head 168. Shaft 166 of each pin 160 is received into aperture 164 in one of receptors 162. One or more O-rings 169 ensure that shaft 166 is tightly received therein. Head 168 of each pin includes an outer surface 168*a* defining a slot 170 therein. Slot 170 is adapted to be engaged by a screwdriver so that pin 160 may be rotated within receptor 162. Head 168 has a rim 172 with three differently elevated inner surfaces thereon, namely surfaces A, B and C. Surface C is of the smallest elevation and extends outwardly from outer surface 168*a* for the smallest distance. Surface B is of intermediate elevation, extending outwardly from outer surface 168*a* for a greater distance than surface C. Surface A is of the greatest elevation, extending further than either surface B or C from outer surface 168*a* of head 168. An inclined surface 163 connects surfaces C and B and a second inclined surface 165 connects surfaces B and A. A stop 167 is provided between surfaces A and C.

Figure 10:
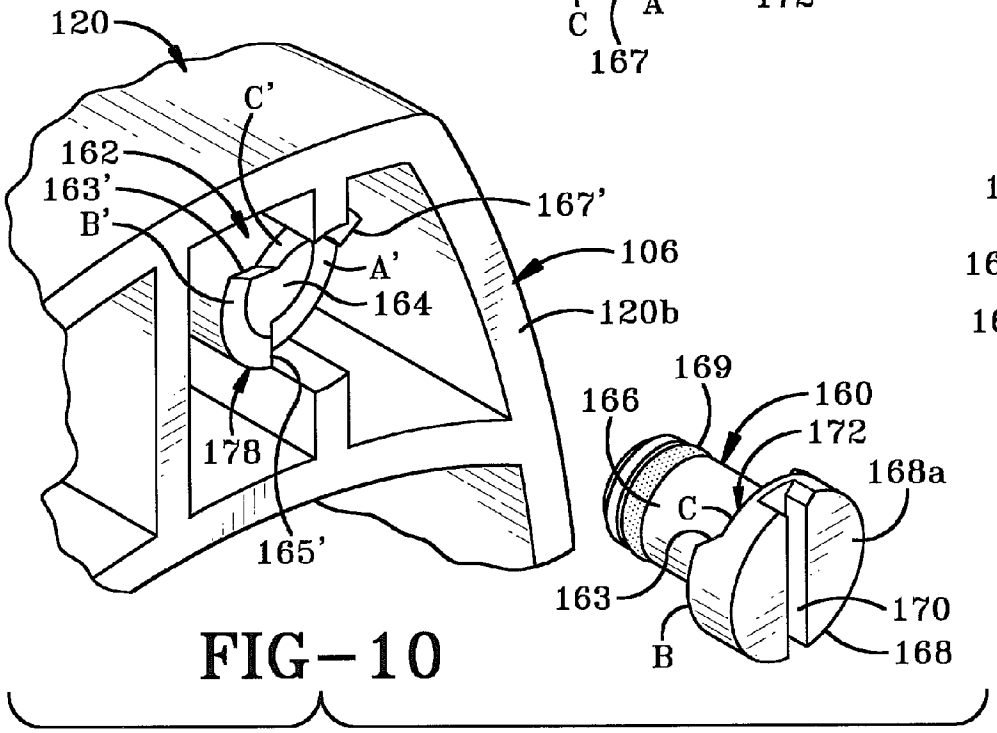
FIG. 10 is an exploded partial perspective view of the base assembly and adjustment screw.

As shown in FIG. 10, receptors 162 have a terminal end with a rim 178 that is complementary shaped to rim 172 of head 168 of pin 160. Rim 178 has three surfaces of different elevations, namely surfaces A', B' and C'. Surface A' is of the smallest elevation extending for the shortest distance outwardly from receptor 162, surface B' is of intermediate elevation and surface C' is of the greatest elevation and extends outwardly further than either of surface A' and B'. Surfaces A' and B' are connected by inclined surface 165', surfaces B' and C' are connected by inclined surface 163' and a stop 167' is provided intermediate surfaces A' and C'.

Figure 11:
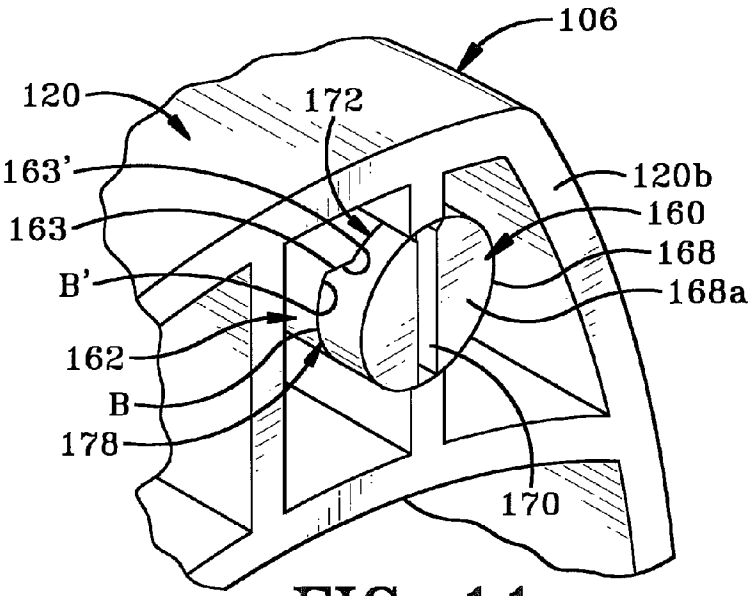
FIG. 11 is a partial perspective view of the base assembly with the adjustment screw engaged therein.
Figure 12:
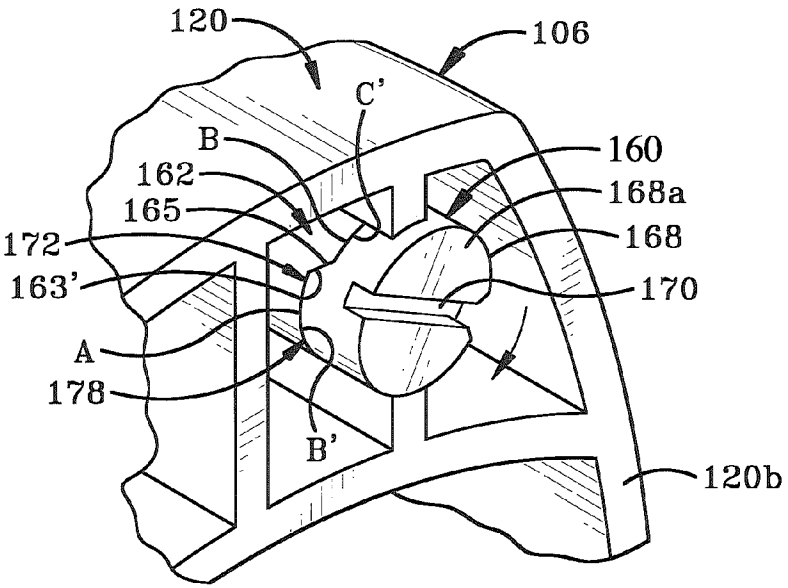
FIG. 12 is a partial perspective view of the base assembly of FIG. 11 and showing rotation of the adjustment screw in a first direction.

As shown in FIGS. 10-12, pin 160 may be inserted into bore 164 of receptor 162 so that rims 172 and 178 interlock. In this instance, surface A interlocks with surface A', surface B interlocks with surface B' and surface C interlocks with surface C'. In this position, pin head 168 will be disposed inwardly of back 120*b* of base assembly 106.

Figure 14:
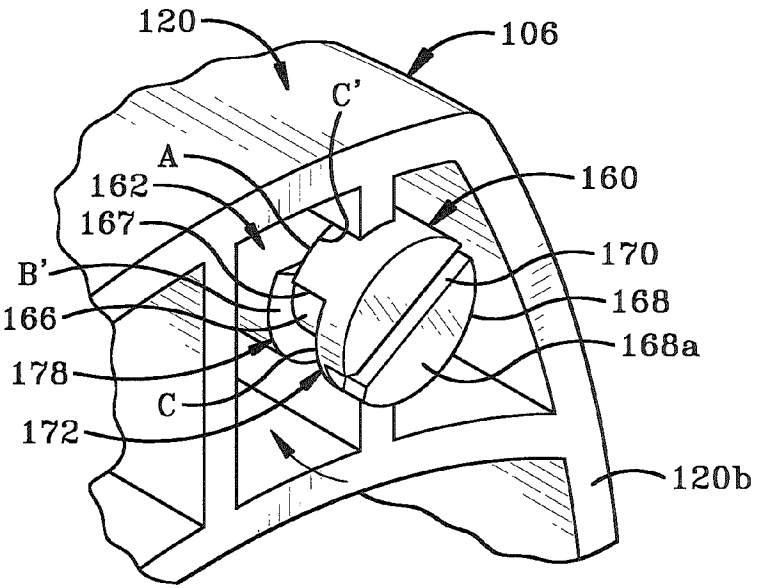
FIG. 14 is a partial perspective view of the base assembly of FIG. 11 showing rotation of the adjustment screw in a second direction.

If base assembly 106 is engaged with rod assembly 108 and is moved into position to secure the same to display board 102, back 120*b* of base assembly 106 should be in abutting contact with display board 102. If, however, display board is thinner than usual, such as display board 102A of FIG. 13, adjustment pins 160 may be used to compensate for this thinner board 102A and thereby correctly position base assembly 106 so as to lock rod assembly 108 to display board 102A. This adjustment of pins 160 is accomplished by engaging a screwdriver into slot 170 in head 168 of pin 160 and rotating the same. This brings non-mating surfaces on rim 172 and 178 into contact with each other. FIG. 14 illustrates one such adjustment where surface A on head 168 has been brought into contact with surface C' on rim 178. As pin 160 is rotated by the screwdriver, the surfaces A, B and C on the rim 172 of pin 160 ride up the inclined surfaces 163', 165' on rim 178 of receptor 162. When pin 160 has been adjusted in this manner, the head 168 of pin 160 extends rearwardly beyond the back 120*b* of base assembly 106. Thus, when base assembly 106 is positioned on rod assembly 108 to lock rod assembly 108 to display board 102A, it is the outer surface 168*a* of head 168 that abuts the outer surface of display board 102A.

Figure 15:
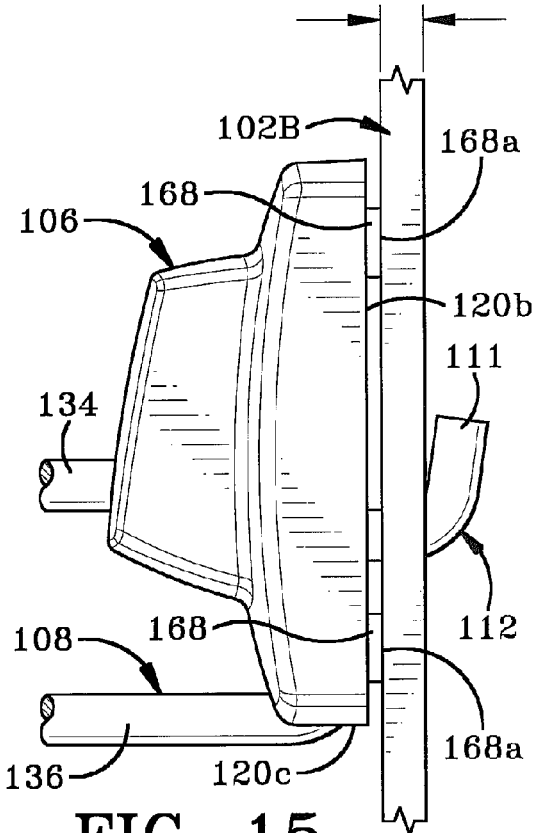
FIG. 15 is a side elevational view of the base assembly and rod assembly of FIG. 14 engaged with a thinner peg board than shown in FIG. 13.

If the display board is even thinner, such as board 102B of FIG. 15, and the distance between board 102B and base assembly 106 is found to be insufficient for securely locking of rod assembly 108 to display board 102B, then a further adjustment of pins 160 may be made. This is accomplished by rotating the pin 160 once more so that the outer surfaces 168*a* of pins 160 extend to the greatest extent rearwardly of back 120*b* of base assembly 106. Again, in this instance, it is the outer surfaces 168*a* of pins 160 that abut the even thinner display board 102B and put a greater distance between back 120*b* and the outer surface of display board 102B. It will be understood that stops 167 and 167' are provided to prevent over-rotation of pins 160. When either the back 120*b* of base assembly 106 or the outer surfaces 168*a* of adjustment pins 160 are in abutting contact with the display board 102, rod assembly 108 cannot be rotated upwardly in the direction indicated by the arrow "X" to disengage members 111 from display board 102. Thus, rod assembly 108 and display board 102 are locked together and cannot be disengaged from each other until base assembly 106 is disengaged from rod assembly 108.

Referring to FIGS. 5 and 6, in order disengage base assembly 106 from rod assembly 108 and thereby release rod assembly 108 from display board 102, the specially designed key 114 must be used. As disclosed in the concurrently filed application for the magnetic key 114, key 114 comprises a housing 115 that retains a specifically shaped dipole magnet therein. The dipole magnet is retained on a slide within housing 115. When key 114 is to be used, a button 117 on housing 115 is activated. This causes the slide to move within housing 115 and to extend at least a portion of the dipole magnet outwardly from the housing 115. This extended portion of the dipole magnet is the protuberance 124 illustrated in the FIGS. 5 and 6. The dipole magnet in question preferably is manufactured from an alloy of neodymium, iron and boron (NdFeB). Specifically, the preferred magnet is a sintered NdFeB magnet which has been nickel-plated. The magnet is specially manufactured to have a specific cross-sectional profile that is complementary in shape and size to the cross-sectional shape of recess 122 in base assembly 106. In the preferred embodiment of the invention, recess 122 is substantially D-shaped and the dipole magnet protuberance 124 on key 114 is also substantially D-shaped in cross-section and is complementary in cross-sectional size. It will be understood, however, that both the recess 122 and protuberance 124 may be formed in another shape, such as trapezoidal, hexagonal, or triangular. Preferably, both recess 122 and dipole magnet 124 are irregular in cross-sectional shape and are non-circular and includes at least one straight side.

The D-shaped dipole magnet 124 is also specially manufactured to have a specific pole at the planar face 124*a* thereof (face 124*a* being the part of protuberance 124 that is brought into the proximity of the locking mechanism in base assembly 106). Magnet 124 is formed to have the opposite pole at the arcuate face 124*b* of protuberance 124. So, for example, the magnet may be manufactured with the north pole at the planar face 124*a* and the south pole at the arcuate face 124*b* directly opposite planar face 124*a*. As discussed previously, shuttle assembly 156 includes a region made from a magnetically attractable metal. If shuttle assembly 156 is itself manufactured from a metal having magnetic properties, then key 114 will only work if the appropriate pole is presented on protuberance 124. So, for example, if shuttle assembly 156 includes a magnet with a north pole adjacent base portion 158 and a south pole adjacent spring 154, then introducing key 114 with a north pole on planar face 124*a* will attract the locking mechanism toward protuberance 124. However, utilizing a key 114 that has a south pole on its planar face 124*a* will not result in the locking mechanism being unlocked as the two south poles will repel each other and the locking mechanism will remain locked. Typically, however, the metal used in shuttle assembly 156 will be non-magnetic but will, instead, be only magnetically attractable to reduce the possibility of damage to electronic security tags used in merchandise 104 displayed on display system 100.

The shape of recess 122 in base assembly 106 substantially prevents the introduction of any non-complementary shaped magnets, such as commonly available bar magnets, into recess 122. Furthermore, the combination of the insulating base portion 158 and the thickness of interior wall 125 (which is also manufactured from an insulating material) substantially prevents the magnetic force field from a non-dipole magnet from penetrating sufficiently therethrough to move shuttle assembly 156 out of locking engagement with upper rod 134. Furthermore, the specificity of the polarity of the dipole magnet also reduces the possibility that any other magnet could be used to unlock the locking mechanism 152 even if it could be inserted into recess 122.

When key 114 is to be used to unlock base assembly 106, housing 115 is positioned on rod 134 and is slidingly moved toward the front of housing 120. Protuberance 124 is inserted into recess 122 and is pushed inwardly until protuberance 124 contacts the interior end wall at the back of recess 122. Recess 122 is orthogonally disposed relative to the direction of linear motion of shuttle assembly 156. The magnetic force field emanating from protuberance 124 attracts shuttle assembly 156 and spring 154 through interior wall 124 and toward planar face 124*a*. This attractive force causes locking mechanism 152 to slide upwardly within chamber 128. The upward movement of shuttle assembly 156 compresses spring 154 and withdraws base portion 158 out of notch 143 in upper rod 134. Once base portion 158 clears side edges 144, 146 on upper rod 134, locking mechanism 152 is unlocked and base assembly 106 is free to slide along rod assembly 108 provided key 114 remains in recess 122 until base portion 158 has cleared side edge 144 of notch 142. When base assembly 106 has been slidably moved along rod assembly 108 in the direction of arrow "Y" to the extent that shuttle assembly 156 has cleared side edge 144 and is no longer situated above notch 142, base assembly 106 is able to freely slide along rod assembly 108 without key 114 remaining engaged in recess 122. Key 114 can therefore be removed therefrom. It should be noted, however, that key 114 does not need to be removed from recess 122 while base assembly 106 is moved along rod assembly 108.

When a sufficient distance has opened up between back 120*a* of base assembly 106 and outer surface 102*a* of display board 102, rod assembly 108 may be rotated in the direction "X" (FIG. 6) and members 111 be withdrawn from holes 103 in display board 102. This releases rod assembly 108 from display board 102.

Rod assembly 108 and base assembly 106 may be left engaged with each other in an unlocked position if, for example, the retailer simply wants to move rod assembly 108 from one set of holes 103 to a different set of holes (not shown) in the display board 102. Once a new location is selected for rod assembly, members 111 are introduced into the new holes, base assembly 106 is slidingly moved in the opposite direction to "Y" until locking mechanism 152 automatically locks when base portion 154 is positioned over notch 142. In this position, locking mechanism 152 is again in its locked position, base assembly 106 is locked onto rod assembly 108, and rod assembly 108 is locked to display board 102.

On the other hand, base assembly 106 can be entirely disengaged from rod assembly 108 by sliding the two components relative to each other until upper and lower rods 134, 136 are withdrawn from hole 126 and passage 130, respectively. Once the free end of upper rod 134 clears the back 120*b* of base assembly 106, locking mechanism 152 slides downwardly in chamber 128 under the force of the expanding spring 154. Base assembly 106 can then only be engaged once again with rod assembly 108 if key 114 is used to slide locking mechanism 152 out of hole 126.

It will be understood that while the base assembly 106 has been described in engagement with a rod assembly 108 that has upper and lower rods 134, 136; the base assembly of the present invention may, alternatively, be used with a rod assembly having only a single rod that includes an upward facing notch. Furthermore, it will be understood that base assembly 106 may be provided with an interior chamber that is disposed in a position to allow shuttle assembly 156 to engage a downwardly facing notch in a rod of rod assembly 108, without departing from the spirit of the present invention. In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

The invention claimed is:

1. A security device for locking a merchandise display rod assembly to a support structure, said device comprising:

a housing adapted to be slidably received on the merchandise display rod assembly, said housing containing a locking mechanism disposed in an interior chamber and including a compression spring seated in a shuttle assembly, said shuttle assembly made of a magnetically attractable material that is sized and shaped for reciprocal travel within the interior chamber, the shuttle assembly being moveable within the interior chamber between a locked position and an unlocked position against a biasing force of the compression spring biasing the shuttle assembly towards the locked position; and a recess formed in the housing and extending inwardly from an exterior surface thereof in the direction of the interior chamber of the housing terminating proximate the interior chamber opposite the compression spring and the shuttle assembly; said recess being adapted to receive a dipole magnet therein for moving the shuttle assembly from the locked position to the unlocked position and permitting the housing to slide on the merchandise display rod assembly away from the support structure to thereby unlock the merchandise display rod assembly from the support structure.

2. The security device as defined in claim 1, wherein said shuttle assembly moves linearly within the interior chamber between the locked position and the unlocked position, and wherein said recess extends perpendicularly with respect to the direction of the linear movement of the shuttle assembly.

3. The security device as defined in claim 1, wherein the recess has a cross-sectional shape that is adapted to receive a complementary cross-sectional shape of the dipole magnet therein.

4. The security device as defined in claim 1, wherein the recess is D-shaped in cross-section and is adapted to receive a complementary D-shaped cross-section of the dipole magnet therein.

5. The security device as defined in claim 4, wherein the D-shaped recess is defined by a substantially planar inner wall and an arcuate inner wall; and wherein the planar inner wall extends to a position proximate the interior chamber retaining the shuttle assembly therein and perpendicularly relative to the direction of the linear movement of the shuttle assembly.

6. A security system for locking a merchandise display rod assembly to a support structure, said system comprising:

a security device comprising:

a housing adapted to be slidably received on the merchandise display rod assembly, said housing containing a locking mechanism disposed in an interior chamber and including a compression spring seated in a magnetically attractable shuttle assembly that is moveable within the interior chamber of the housing between a locked position and an unlocked position, the shuttle assembly being sized and shaped for reciprocal travel within the interior chamber between the locked position and the unlocked position against a biasing force of the compression spring biasing the shuttle assembly towards the locked position, and a recess formed in the housing and extending inwardly from an exterior surface thereof in the direction of the interior chamber of the housing and terminating proximate the interior chamber opposite the compression spring and the shuttle assembly of the locking mechanism; and a dipole magnet configured to be received within the recess and said recess being adapted to receive the dipole magnet therein for moving the shuttle assembly from the locked position to the unlocked position and permitting the housing to slide along the merchandise display rod assembly away from the support structure to thereby unlock the merchandise display rod assembly from the support structure.

7. The security system as defined in claim 6, wherein the shuttle assembly moves linearly within the interior chamber between the locked position and the unlocked position, and the recess is oriented perpendicularly with respect to the direction of the linear movement of the shuttle assembly.

8. The security system as defined in claim 6, wherein the dipole magnet and the recess are complementary in cross-sectional shape.

9. The security system as defined in claim 8, wherein the cross-sectional shape of both of the dipole magnet and the recess includes at least one straight side.

10. The security system as defined in claim 8, wherein the dipole magnet and the recess are substantially D-shaped in cross-section.

11. The security system as defined in claim 10, wherein the dipole magnet has a planar face and an arcuate face; and the dipole magnet is a neodymium, iron, boron magnet having one of a north and south pole on the planar face and the other of the north and south pole on the arcuate face.

12. The security system as defined in claim 11, wherein the recess is oriented such that the planar face of the dipole magnet is brought into closer proximity to the shuttle assembly than is the arcuate face of the dipole magnet.

13. The security system as defined in claim 6, wherein the dipole magnet is a neodymium, iron, boron magnet.

* * * * *